US008006318B2

(12) United States Patent
Gallo

(10) Patent No.: US 8,006,318 B2
(45) Date of Patent: Aug. 30, 2011

(54) NECK WARMER

(76) Inventor: Marilyn A. Gallo, West Palm Beach, FL (US)

( * ) Notice: Subject to any disclaimer, the term of this patent is extended or adjusted under 35 U.S.C. 154(b) by 374 days.

(21) Appl. No.: 12/289,790

(22) Filed: Nov. 4, 2008

(65) Prior Publication Data

US 2010/0107301 A1 May 6, 2010

(51) Int. Cl.
*A41D 23/00* (2006.01)

(52) U.S. Cl. ..... 2/91; 2/207

(58) Field of Classification Search ..... 2/91, 207, 2/49.1, 52, 104, 155, 156, 49.5, 48, 468, 2/172, 60, 144–146, 181, 92, 130, 174; D2/500, D2/501, 508, 600, 602, 609
See application file for complete search history.

(56) References Cited

U.S. PATENT DOCUMENTS 766,963 A * 8/1904 Murray ..... 2/91
781,232 A * 1/1905 Saks ..... 2/203
828,967 A * 8/1906 Reichblum ..... 2/91
856,720 A * 6/1907 Neuman ..... 2/91
866,752 A * 9/1907 Way ..... 2/91
963,235 A * 7/1910 Mead ..... 66/171
1,006,288 A * 10/1911 Rosenfeld ..... 2/91
1,176,482 A * 3/1916 Orme ..... 2/91
1,325,755 A * 12/1919 Sampliner ..... 66/171
1,499,911 A * 7/1924 Dalzell ..... 2/207
2,089,995 A * 8/1937 Dobbs ..... 2/207
2,117,973 A * 5/1938 Misewicz et al. ..... 2/91
2,431,568 A * 11/1947 Kovitz ..... 2/204
2,568,826 A * 9/1951 Roussos ..... 2/244
2,585,686 A * 2/1952 Rossant ..... 2/91
2,809,375 A * 10/1957 Doron ..... 2/91
3,261,025 A * 7/1966 Simek ..... 2/149
3,276,037 A * 10/1966 Englehaupt ..... 2/146
3,439,360 A 4/1969 Grubman
3,613,117 A * 10/1971 Gingerich ..... 2/149
3,733,614 A 5/1973 Abramowitz
4,301,548 A * 11/1981 Blake ..... 2/91
4,394,782 A * 7/1983 Wasson ..... 2/181
4,492,242 A * 1/1985 Dalton ..... 132/53
4,654,897 A 4/1987 Rosaen
4,718,123 A 1/1988 Petropoulos
5,115,516 A 5/1992 Golde
5,621,919 A * 4/1997 Graham ..... 2/174
D380,586 S * 7/1997 Burthey, III ..... D2/605
5,685,016 A * 11/1997 Douglas ..... 2/171
D531,385 S * 11/2006 Lund ..... D2/500
2007/0017004 A1 1/2007 Sims-Perry

OTHER PUBLICATIONS

Gershman, Maurice, "Self-Adhering Nylon Tapes", Oct. 18, 1958. Journal of AMA, vol. 168, No. 7 (1 page).*

* cited by examiner

*Primary Examiner* — Amy B Vanatta
(74) *Attorney, Agent, or Firm* — Richard C. Litman

(57) ABSTRACT

The neck warmer includes a collar fabricated from warm, soft material and having free ends provided with hook and loop fasteners to allow the collar to be fastened closely around a wearer's neck. The collar has a slight V-shape at its front. Ornamental pieces can be optionally attached to the front of the collar to create a desired fashionable effect.

6 Claims, 4 Drawing Sheets

NECK WARMER

BACKGROUND OF THE INVENTION

1. Field of the Invention

The present invention generally relates to wearing apparel, and more particularly to a neck warmer that can be worn around the neck as a scarf or collar and has ancillary removable, ornamental attachments.

2. Description of the Related Art

There are many times when one is in need of a garment to protect the neck from the cool air. Heretofore, the conventional scarf has been employed to accomplish this task. Unfortunately, the design of the conventional scarf presents some drawbacks for the wearer. For example, the scarf must be wrapped around the neck to attain maximum protection. This scenario presents a somewhat bulky and uncomfortable scarf layer at the neck. Furthermore, it is difficult to wrap the scarf in a manner wherein the free ends hang evenly, thus presenting a somewhat unfashionable look. Tucking the free ends inside other clothing is not a satisfactory solution in that the ensuing bulkiness is unsightly. The art would certainly welcome a non-bulky neck wrap that could be easily donned, removed and provided with interchangeable ornamental pieces for projecting a fashion statement.

Thus, a neck warmer solving the aforementioned problems is desired.

SUMMARY OF THE INVENTION

The neck-warmer comprises a collar fabricated from warm, soft material having free ends provided with hook and loop fasteners to allow the collar to be fastened closely around a wearer's neck. The collar has a slight V-shape at its front. Ornamental pieces can be optionally attached to the front of the collar to create a desired, fashionable effect.

Accordingly, the invention presents a neck warmer that does not require tying or odious wrapping. The neck warmer is easy to don and remove. Ornamental adjuncts can be optionally attached to the collar to create a desired fashion look. The invention provides for improved elements thereof in an arrangement for the purposes described that are inexpensive, dependable and fully effective in accomplishing their intended purposes.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
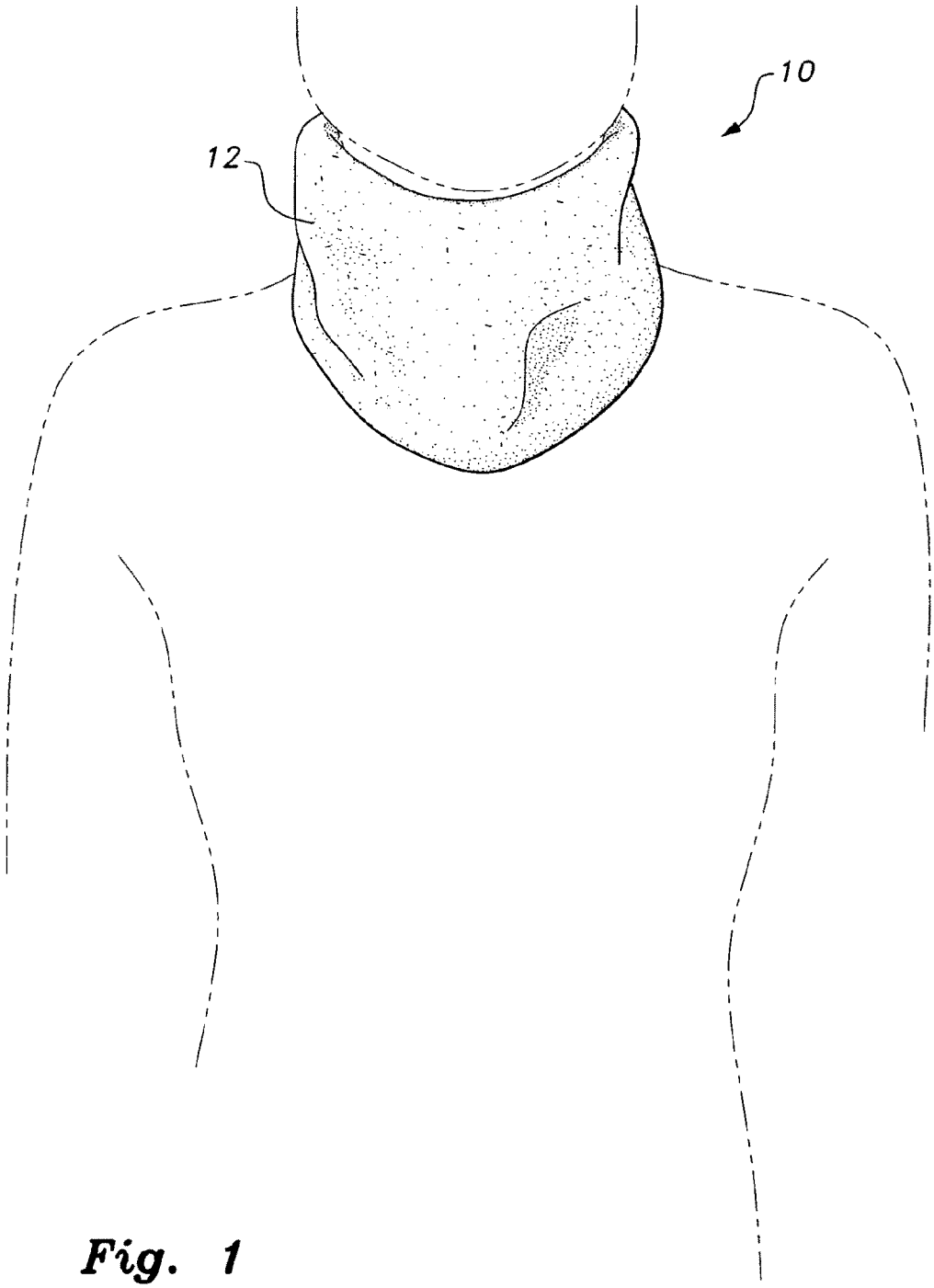
FIG. 1 is an environmental, perspective view of a neck warmer according to the present invention, shown without ornamental attachments.
Figure 2:
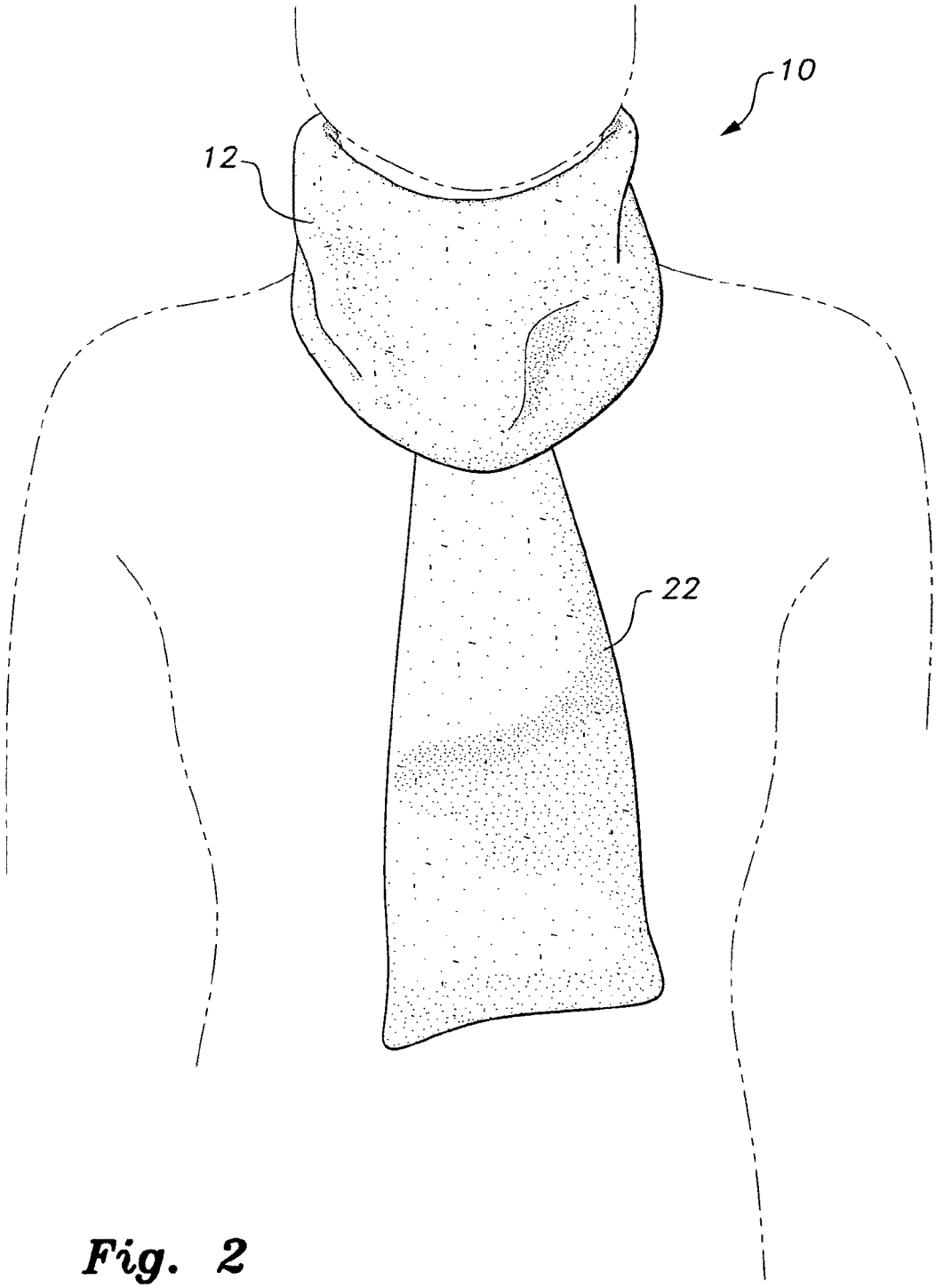
FIG. 2 is an environmental, perspective view of a neck warmer according to the present invention, shown with one ornamental attachment.
Figure 3:
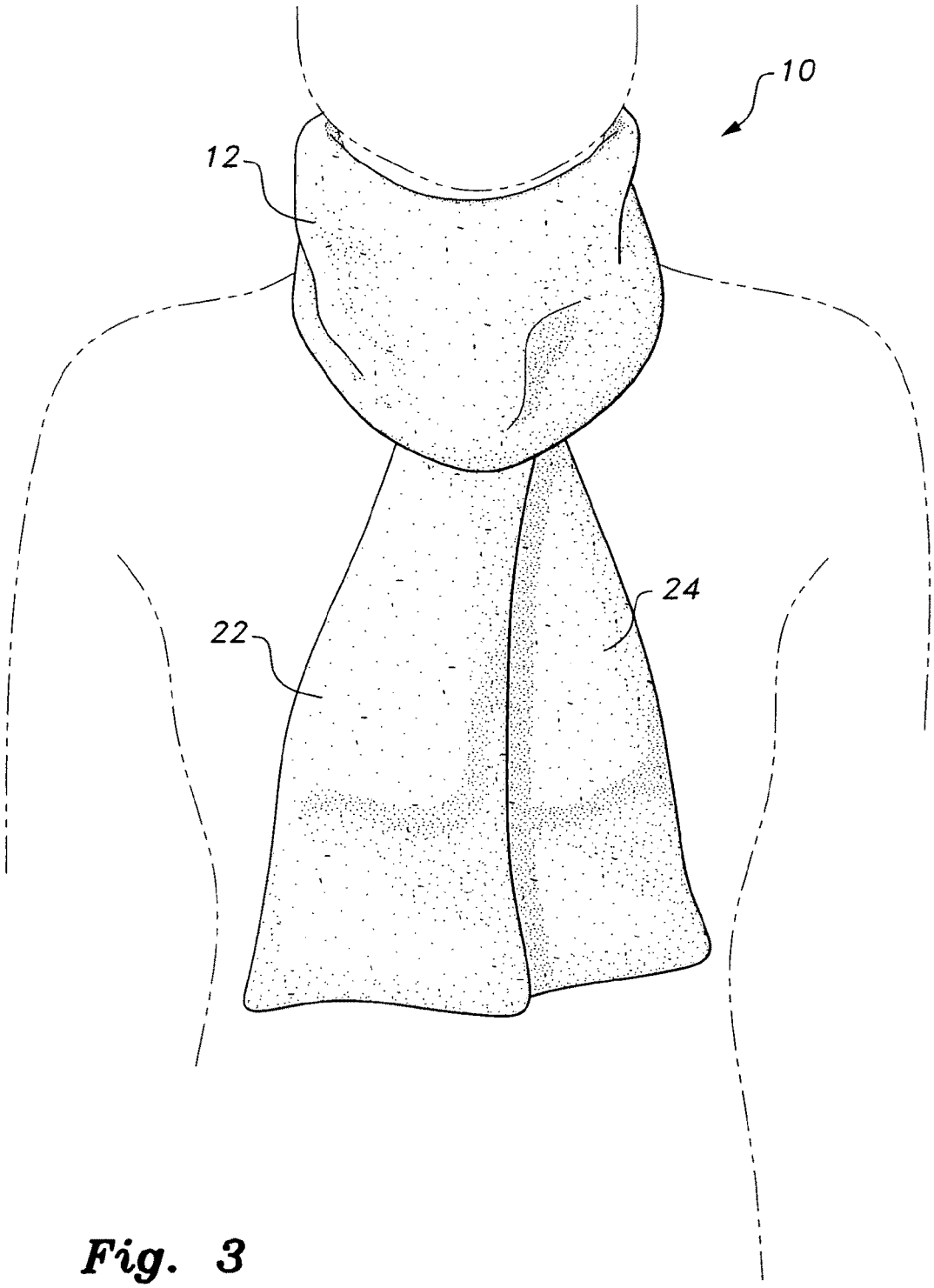
FIG. 3 is an environmental, perspective view of a neck warmer according to the present invention, shown with two ornamental attachments.

Attention is first directed to FIG. 1, wherein a first configuration of a neck warmer of the present invention is generally indicated at 10. The neck warmer 10 is shown utilized as a collar or neck-wrap 12 with no attachments. The configuration shown in FIG. 2 incorporates a single ornamental tie 22 that can be optionally attached to collar 12. FIG. 3 shows the collar 12 configured with two optionally attached ties 22, 24.

Figure 4:
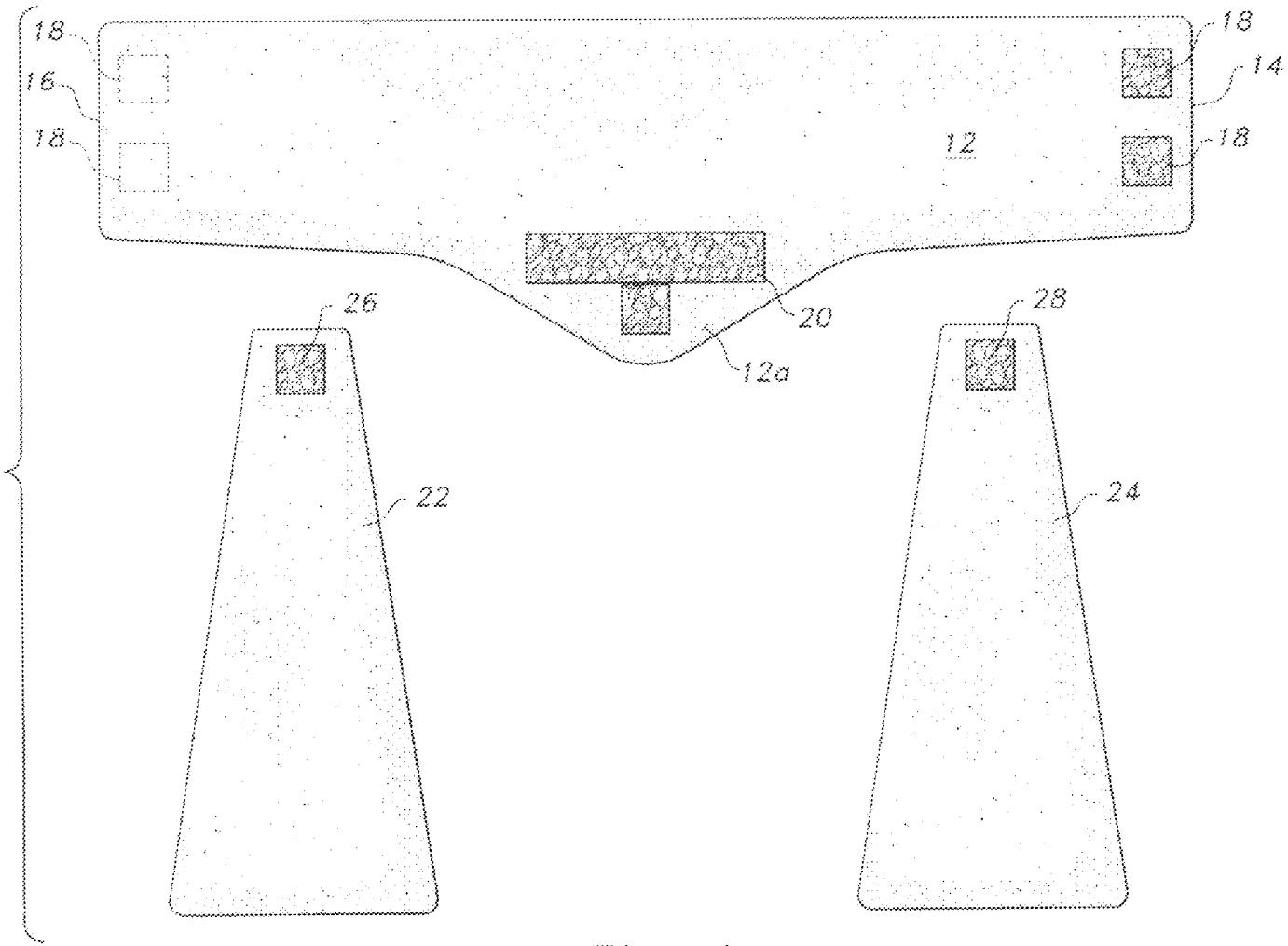
FIG. 4 is an exploded rear view of a neck warmer according to the present invention, shown with two ornamental attachments.

As best seen in FIG. 4, collar 12 comprises a single, elongate member having front and rear surfaces and free ends 14 and 16. A plurality of fasteners 18 (preferably hook and loop) are disposed adjacent each respective free end on opposing surfaces. This arrangement allows a wearer to quickly and easily fasten the collar around his/her neck. A shallow V-shaped configuration 12*a* is formed on the lower edge of collar 12. The V-shaped configuration can be tucked beneath the wearer's clothing to hold the bottom edge of the collar securely around the wearer's neck. Another hook and loop fastener 20 is disposed on the inner surface of collar 12 adjacent the V-shaped configuration for reasons as will be explained below. As indicated above, two ornamental ties 22 and 24 are provided for optional attachment to collar 12. Each ornamental tie is provided with a respective hook and loop fastener 26, 28 on one surface thereof. The respective ornamental ties are attached to the collar by means of hook and loop fasteners 20, 26 and 28. Although hook and loop fasteners are preferred, it should be recognized that other suitable fasteners (buttons, zippers, etc.) could be utilized if suitable.

Preferably, collar 12 will have a circumference of approximately eight to twenty-four inches and a width of 3 to 6 inches. The removable ornamental ties will have a length of eight to twelve inches. Both collar and ornamental ties are fabricated from a suitable soft, pliable material such as nylon, fur, cashmere, cotton, etc. and can be made in various colors. The ornamental ties can be further adorned with decorative ends that may include tassels, beads, strands and the like to satisfy different aesthetic desires.

It is to be understood that the present invention is not limited to the embodiments described above, but encompasses any and all embodiments within the scope of the following claims.

I claim:

1. A neck warmer, comprising:

a one-piece collar having a top edge and a substantially parallel bottom edge, a front surface, a rear surface, a first free end and a second free end, the bottom edge having a shallow substantially V-shaped configuration formed at a central area of the collar, wherein the remainder of the collar retains the parallel edges;

first fastener devices disposed on the front surface of the collar adjacent the first free end;

second fastener devices disposed on the rear surface of the collar adjacent the second free end;

third fastener devices disposed solely on the rear surface of the collar adjacent the shallow substantially V-shaped configuration at the central area of the collar; and further including at least one ornamental tie removably attached to the third fastener at the central area.

2. The neck warmer according to claim 1, wherein said first, second and third fastener devices are hook and loop fastener devices.

3. The neck warmer according to claim 1, wherein said collar is fabricated from a soft, pliable material.

4. The neck-warmer according to claim 1, further including two ornamental ties removably attached to said collar at the central area.

5. The neck-warmer according to claim 1, wherein said collar has a circumference of approximately eight to twenty-fourth inches and a width of approximately 3 to 6 inches.

6. The neck warmer according to claim 2, wherein said at least one ornamental tie having a front surface, a rear surface and a length of approximately eight to twelve inches; and a fourth hook and loop fastening device disposed on the front surface of the at least one ornamental tie.

* * * * *